US009196124B2

(12) United States Patent
Vermaak et al.

(10) Patent No.: US 9,196,124 B2
(45) Date of Patent: Nov. 24, 2015

(54) NUDGE FEATURES IN REEL-TYPE GAMES

(75) Inventors: Richard Vermaak, Durban (ZA); Theo Naicker, Durban (ZA); Brendan Clyde Walton, Chaka's Rock (ZA); Terence Igesund, Durban (ZA)

(73) Assignee: Cork Group Trading Ltd., Road Town, Tortola (VG)

( * ) Notice: Subject to any disclaimer, the term of this patent is extended or adjusted under 35 U.S.C. 154(b) by 0 days.

(21) Appl. No.: 13/353,756

(22) Filed: Jan. 19, 2012

(65) Prior Publication Data

US 2013/0184046 A1 Jul. 18, 2013

(30) Foreign Application Priority Data

Jan. 16, 2012 (GB) ..... 1200663.1

(51) Int. Cl.

*A63F 9/24* (2006.01)
*G07F 17/32* (2006.01)
*G07F 17/34* (2006.01)

(52) U.S. Cl.

CPC ..... *G07F 17/3265* (2013.01); *G07F 17/34* (2013.01)

(58) Field of Classification Search

CPC . G07F 17/3265; G07F 17/34; G07F 17/3211; G07F 17/3209; G07F 17/3223; G07F 17/326
USPC ..... 463/20, 25
See application file for complete search history.

(56) References Cited

U.S. PATENT DOCUMENTS 4,836,553 A 6/1989 Suttle et al.
4,948,134 A 8/1990 Suttle et al.
5,374,067 A 12/1994 Jones
5,764,518 A 6/1998 Collins
5,848,932 A 12/1998 Adams (Continued)

FOREIGN PATENT DOCUMENTS

AU 2003100455 9/2003
AU 781843 B2 6/2005

(Continued)

OTHER PUBLICATIONS

Australian Government—IP Australia, Patent Examination Report No. 1 for Patent Application No. 2013200061, dated Oct. 15, 2013, 3 pages.

(Continued)

*Primary Examiner* — Steve Rowland
(74) *Attorney, Agent, or Firm* — McDonnell Boehnen Hulbert & Berghoff LLP

(57) ABSTRACT

Methods, machines, and systems for additional movement of one or more symbols of a reel-type game after the reels are spun for a turn of the reel-type game, but before a next turn of the game, are described. The symbol(s) moved after the reels are spun may comprise a scatter symbol or a symbol other than a scatter symbol. A tip of an off-reel-display symbol positioned outside of a reel-display area may be visible within the reel-display area to notify a player of the reel-type game that additional movement of the off-reel-display symbol is imminent. The off-reel-display symbol may be moved, onto a symbol that is being displayed within the reel-display area, after payment of any award(s) earned for certain combinations of symbols occurring on paylines with the reel-display area and/or after payment of any awards earned for a prescribed number of scatter symbols being displayed within the reel-display area.

24 Claims, 6 Drawing Sheets

(56) References Cited

U.S. PATENT DOCUMENTS

| | | | | |
|---|---|---|---|---|
| 6,089,977 | A | 7/2000 | Bennett | |
| 6,117,013 | A | 9/2000 | Eiba | |
| 6,336,863 | B1 | 1/2002 | Baerlocher et al. | |
| 6,364,313 | B1 | 4/2002 | Moody | |
| 6,398,218 | B1 | 6/2002 | Vancura | |
| 6,413,162 | B1 | 7/2002 | Baerlocher et al. | |
| 6,419,578 | B1 | 7/2002 | Moody et al. | |
| 6,485,368 | B2 | 11/2002 | Jones et al. | |
| 6,551,187 | B1 * | 4/2003 | Jaffe | 463/20 |
| 6,565,434 | B1 | 5/2003 | Acres | |
| 6,676,512 | B2 | 1/2004 | Fong et al. | |
| 6,752,395 | B2 | 6/2004 | Jones et al. | |
| 6,786,818 | B1 * | 9/2004 | Rothschild et al. | 463/20 |
| 6,800,030 | B2 | 10/2004 | Acres | |
| 6,811,486 | B1 | 11/2004 | Luciano, Jr. | |
| 6,910,964 | B2 | 6/2005 | Acres | |
| RE38,812 | E | 10/2005 | Acres et al. | |
| 6,955,600 | B2 | 10/2005 | Glavich et al. | |
| 6,988,947 | B2 | 1/2006 | Baerlocher et al. | |
| 7,144,322 | B2 | 12/2006 | Gomez et al. | |
| 7,204,754 | B2 | 4/2007 | Gray et al. | |
| 7,371,170 | B2 | 5/2008 | Cregan et al. | |
| 7,473,173 | B2 | 1/2009 | Peterson et al. | |
| 7,494,413 | B2 | 2/2009 | Singer et al. | |
| 7,503,848 | B2 | 3/2009 | Berman et al. | |
| 7,578,735 | B2 | 8/2009 | Frizzell et al. | |
| 7,578,738 | B2 | 8/2009 | Cregan et al. | |
| 7,591,724 | B2 | 9/2009 | Baerlocher | |
| 7,597,618 | B2 | 10/2009 | Webb et al. | |
| 7,601,062 | B2 | 10/2009 | Cole et al. | |
| 7,674,180 | B2 | 3/2010 | Graham et al. | |
| 7,677,968 | B2 | 3/2010 | Schultz et al. | |
| 7,690,983 | B2 | 4/2010 | Hartl et al. | |
| 7,753,769 | B2 | 7/2010 | Gomez et al. | |
| 7,758,414 | B1 | 7/2010 | Marks et al. | |
| 7,794,317 | B2 | 9/2010 | Kaminkow et al. | |
| 7,819,737 | B2 | 10/2010 | Englman et al. | |
| 7,824,262 | B2 | 11/2010 | Webb et al. | |
| 7,867,079 | B2 | 1/2011 | Govender et al. | |
| 7,976,376 | B2 | 7/2011 | Kroeckel et al. | |
| 7,993,199 | B2 | 8/2011 | Iddings et al. | |
| 8,012,009 | B2 | 9/2011 | Iddings et al. | |
| 8,087,995 | B2 | 1/2012 | Englman et al. | |
| 8,088,001 | B2 | 1/2012 | Preisach | |
| 2003/0022712 | A1 * | 1/2003 | Locke | 463/20 |
| 2003/0087690 | A1 * | 5/2003 | Loose et al. | 463/20 |
| 2003/0190947 | A1 * | 10/2003 | Baerlocher et al. | 463/20 |
| 2004/0023714 | A1 | 2/2004 | Asdale | |
| 2004/0048650 | A1 * | 3/2004 | Mierau et al. | 463/20 |
| 2004/0132527 | A1 | 7/2004 | Berman et al. | |
| 2004/0166923 | A1 | 8/2004 | Michaelson et al. | |
| 2004/0198486 | A1 | 10/2004 | Walker et al. | |
| 2005/0054420 | A1 * | 3/2005 | Cregan et al. | 463/20 |
| 2005/0054436 | A1 * | 3/2005 | Frizzell et al. | 463/25 |
| 2005/0059474 | A1 | 3/2005 | O'Halloran | |
| 2005/0070353 | A1 | 3/2005 | Webb et al. | |
| 2005/0075163 | A1 | 4/2005 | Cuddy et al. | |
| 2005/0130732 | A1 | 6/2005 | Rothschild et al. | |
| 2005/0192086 | A1 | 9/2005 | Walker et al. | |
| 2006/0046830 | A1 | 3/2006 | Webb | |
| 2006/0068893 | A1 | 3/2006 | Jaffe et al. | |
| 2006/0189377 | A1 * | 8/2006 | Gomez et al. | 463/20 |
| 2007/0060297 | A1 | 3/2007 | Hein et al. | |
| 2007/0060303 | A1 | 3/2007 | Govender et al. | |
| 2007/0213121 | A1 | 9/2007 | Moshal et al. | |
| 2008/0064465 | A1 | 3/2008 | Bennett | |
| 2008/0108411 | A1 | 5/2008 | Jensen et al. | |
| 2008/0167114 | A1 | 7/2008 | Graham | |
| 2008/0188280 | A1 | 8/2008 | Marks et al. | |
| 2009/0111566 | A1 | 4/2009 | Naicker et al. | |
| 2009/0286588 | A1 | 11/2009 | Jackson | |
| 2010/0004050 | A1 * | 1/2010 | Caputo et al. | 463/21 |
| 2010/0016071 | A1 | 1/2010 | Jaffe et al. | |
| 2010/0190542 | A1 | 7/2010 | Mizue | |
| 2011/0028202 | A1 | 2/2011 | Naicker et al. | |
| 2011/0223991 | A1 | 9/2011 | Powell et al. | |

FOREIGN PATENT DOCUMENTS

| | | | |
|---|---|---|---|
| AU | 2009251197 | | 7/2011 |
| EP | 1063622 | A2 | 12/2000 |
| GB | 2097160 | A | 10/1982 |
| WO | 2006/027677 | A2 | 3/2006 |

OTHER PUBLICATIONS

European Patent Office, Communication pursuant to Article 94(3) EPC for Application No. 13 151 141.2-1958, dated Feb. 19, 2014, 5 pages.

United Kingdom Intellectual Property Office, Combined Search and Examination Report under Sections 17 and 18(3) for United Kingdom Patent Application No. GB1200663.1, 10 pages, Jun. 14, 2013.

European Patent Office, Extended European Search Report for European Patent Application No. EP 13151141.2-1958, Apr. 22, 2013, 7 pages.

Cindyjean, Popomatic Trouble—Milton Bradley Trouble—Epinions.com, downloaded from the World Wide Web at http://www.epinions.com/review/Milton_Bradley_Trouble/content_42532310660 on Sep. 2, 2011, pp. 1-4.

U.S. Appl. No. 13/353,519, filed Jan. 19, 2012, 39 pages.

* cited by examiner

NUDGE FEATURES IN REEL-TYPE GAMES

PRIORITY

This application claims priority benefits under 35 U.S.C. §119 to United Kingdom Patent Application Serial No. GB 1200663.1 filed Jan. 16, 2012.

STATEMENT REGARDING FEDERALLY SPONSORED RESEARCH OR DEVELOPMENT

Not applicable.

BACKGROUND

This disclosure relates generally to the field of wager games and more particularly to methods and apparatus that facilitate the use of "nudge" features in reel-type game. The methods are applicable in a variety of game playing formats, for example physical slot machines, electronic video gaming terminals, and computer workstations playing wager games over a computer network.

In reel-type games such as slots, one or more reels are provided, each of which contain a multitude of symbols distributed around the circumference of the reel. When a player places a wager (e.g., by placing a coin in the machine) they are then permitted to spin the reels. Each reel comes to rest, with typically with either one of the symbols, or a space in between the symbols, in alignment with a pay line. The player wins according to whether a particular winning symbol or combination of symbols is present on the pay line. In a simple three-reel slot machine game, the pay line is the horizontal line going across the middle of the reels. In other reel-type games, such as an array of 3×5 symbols which all "spin" during a turn of play, the "pay line" refers to a particular combination of positions of symbols in the 3×5 array which are used to determine if a winning result was achieved.

The game of slots can be played on a video gaming terminal with a graphical user interface, e.g., a dedicated gaming machine such as found in a casino. In the case of a video gaming terminal, the user interface displays an image of a set of reels. Animation effects are used to simulate the spinning action. A computer software program, which may be resident in the video gaming terminal, generates a random result for a simulated spin of the reels, and the result is presented on the user interface.

Slots games are also played over a computer network, e.g., by a player using a personal computer which has established a connection to a gaming server. In this later situation, the gaming server generates results of play and transmits the results over the computer network to the computer for display.

The popularity of video slot games has increased due to the incorporation of a "nudge" feature into such video slot games. In a video slot game with a nudge feature, once the reels of the game come to rest (i.e. stop spinning), visible symbols will move onto the centre pay line from just above it or below it, adding to the suspense of the game. Alternatively, the nudge feature may form part of a bonus game which, when triggered, provides a player with a predetermined number of nudges to use, allowing the player to move any of the reels upwards (or downwards) one position at a time in an attempt to give rise to winning pay line symbol combinations or bonus-triggering combinations.

It is desirable to adapt such nudge features in novel ways to further enhance the entertainment value and suspense of video slot games.

SUMMARY

Example embodiments are described herein. In one respect, an example embodiment is arranged as a method of playing a reel-type game using a machine having a display device. The method comprises (i) providing, at the display device, a reel-display area to display a plurality of reels, wherein each reel of the plurality of reels comprises a respective plurality of symbols, (ii) displaying, within the reel-display area of the display device, a result of spinning the plurality of reels for a first turn of the reel-type game, and (iii) displaying, within the reel-display area of the display device, a first off-reel-display symbol moved onto an adjacent symbol that is being displayed as part of the result of spinning the plurality of reels for the first turn of the reel-type game.

In another respect, an example embodiment is arranged as a machine configured to enable a player to play a reel-type game. The machine comprises (i) a processing unit, (ii) a non-transitory computer-readable storage medium storing computer-readable program instructions executable by the processing unit, and (iii) a display device configured to provide a reel-display area to display a plurality of reels, wherein each reel of the plurality of reels comprises a respective plurality of symbols. The computer-readable program instructions are executable by the processing unit to cause the display device to display, within the reel-display area of the display device, a result of spinning the plurality of reels for a first turn of the reel-type game. The computer-readable program instructions are executable by the processing unit to cause the display device to display, within the reel-display area of the display device, a first off-reel-display symbol moved onto an adjacent symbol that is being displayed as part of the result of spinning the plurality of reels for the first turn of the reel-type game.

In yet another respect, an example embodiment is arranged as a gaming server configured to communicate with a machine that enables a player to play a reel-type game via a communications network. The gaming server comprises a processing unit configured to generate results of spinning a plurality of reels for each turn of the reel-type game being played at the machine and to cause the generated results of spinning the plurality of reels in the reel-type game to be transmitted to the machine as a respective datagram for each turn of the reel-type game via the communications network. A first datagram generated by the processing unit for a first turn of the reel-type game includes data indicating the result of spinning the plurality of reels for the first turn of the reel-type game and a first off-reel-display symbol to be moved onto an adjacent symbol to be displayed at the machine as part of the result of spinning the plurality of reels for the first turn of the reel-type game.

In still yet another respect, an example embodiment is arranged as a method of facilitating play of a reel-type game at a machine that communicates with a gaming server via a communications network. The method comprises (i) generating, via a processing unit of the gaming server, results for spinning a plurality of reels for a first turn of the reel-type game at the machine, and (ii) transmitting, from the gaming server to the machine via the communications network, a first datagram including data indicating the results for spinning the plurality of reels for the first turn of the reel-type game and a first off-reel-display symbol to be moved onto an adjacent symbol to be displayed by the machine as part of the results for spinning the plurality of reels for the first turn of the reel-type game.

These as well as other aspects and advantages will become apparent to those of ordinary skill in the art by reading the following detailed description, with reference where appropriate to the accompanying drawings. Further, it should be understood that the embodiments described in this summary and elsewhere are intended to be examples only and do not necessarily limit the scope of the invention.

DETAILED DESCRIPTION

I. Introduction

Figure 1:
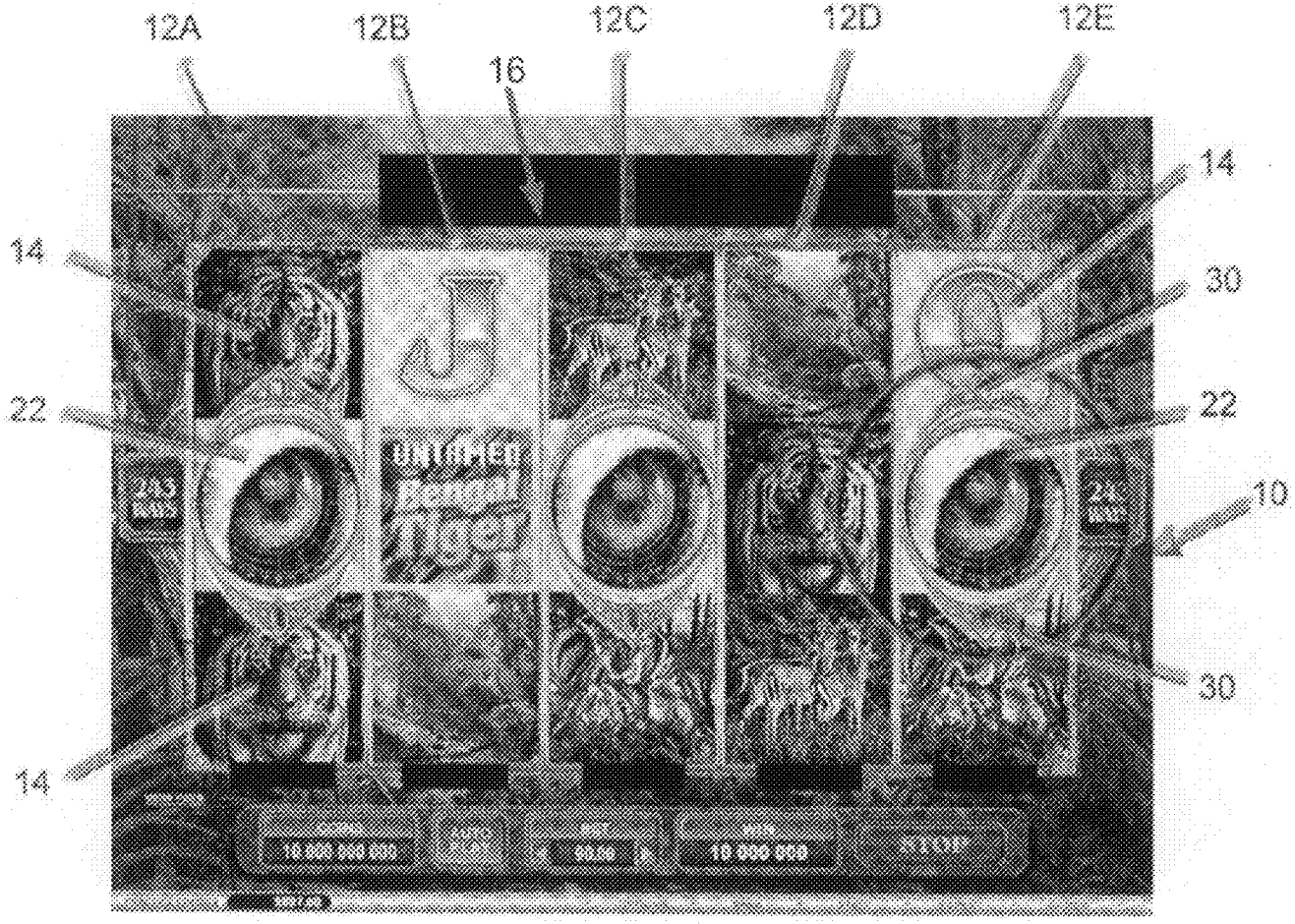
FIG. 1 is an illustration of the display of a machine used to play a reel-type game.

Reel-type games are disclosed which provide a player with nudge-type functionality, thereby heightening anticipation and increasing excitement of the game. This may be achieved by providing a triggering mechanism for nudging a reel (or reels) if it is determined that, by doing so, a winning payout and/or winning event will result. The triggering mechanism may be implemented via computer-readable program instructions executable by one or more processing units, such as a processing unit within a machine that displays the reel(s) and/or a processing unit within a gaming server that provides the machine with data for displaying the reel(s).

The games of this disclosure are typically played on a machine which is configured to play a reel-type game. For purposes of this description, a reel-type game may be played for a wager (e.g., a reel-type wager game) or played without a wager (e.g., a reel-type non-wager game played for amusements purposes). The reel-type games of this disclosure, regardless of whether being played for wager or without a wager, may feature one or more scatter symbols in addition to a plurality of regular reel-type game symbols that do not comprise a scatter symbol (i.e., a non-scatter symbol).

Scatter symbols may be displayed on a pay line defined for a reel-display area. However, unlike regular reel-type symbols in a video slot game with a reel-display area, a scatter symbol is one that does not have to appear on a specific pay line in order to produce a winning result. With scatter symbols, payouts occur as a result of the scatter symbols occurring on the reels within the reel-display area. Furthermore, obtaining a prescribed number of scatter symbols in a reel-type wager game need not only result in a monetary prize but could, alternatively or additionally, trigger a bonus game. The machine includes a display device configured to display two or more reels of a reel-type game, a memory storing software instructions for facilitating a user to play the reel-type game, and a processing unit for executing the software instructions. The scatter symbol may take any form and could for example be the letter "S", the word "Scatter" or any other symbol.

II. Example Operation

This is best illustrated by example with reference to a sequence of screen shots shown in FIGS. 1-4. These screen shots show a display on a user interface (10) of a game playing machine used for playing a reel-type game. The machine may take the form of and be referred to as a video gaming terminal, a slot machine, a general purpose computer, a personal digital assistant, a cellular telephone, a game playing machine, or another electronic device. The machine includes a memory (not shown but conventional in such machines) for storing software instructions and a processing unit (e.g., CPU or microprocessor) which executes the instructions stored in the machine, which again is conventional. The sequence and organization of the software instructions will be apparent to persons skilled in the art from the description and illustrated examples of operation of the various embodiments of the invention set forth below.

In particular, FIG. 1 is a representation of a five-reel video slot game which is presented on the display (10) of the game playing machine. Symbols (14) are displayed in an array of symbols (14) in M rows and N columns, here M=3 and N=5. Other examples of the quantity of M rows and N columns (e.g., M=3 and N=3 or M=3 and N=4) are also possible.

Each column is in the form of a reel (12A, 12B, 12C, 12D, and 12E), but the gaming machines of this description are not so limited, because in alternative embodiments each row may be arranged in the form of a reel rather than each column. Each reel (12A, 12B, 12C, 12D, and 12E) displays three symbols within a reel-display area (16) after the reels are spun during a turn of the game. The game has up to 243 pay lines, each comprising a unique sequence of array symbols (14), one from each reel (12A, 12B, 12C, 12D, and 12E), and going from left to right across the reel-display area (16). The pay lines in a game of this type are known in the art and the details are not particularly important.

Figure 2:
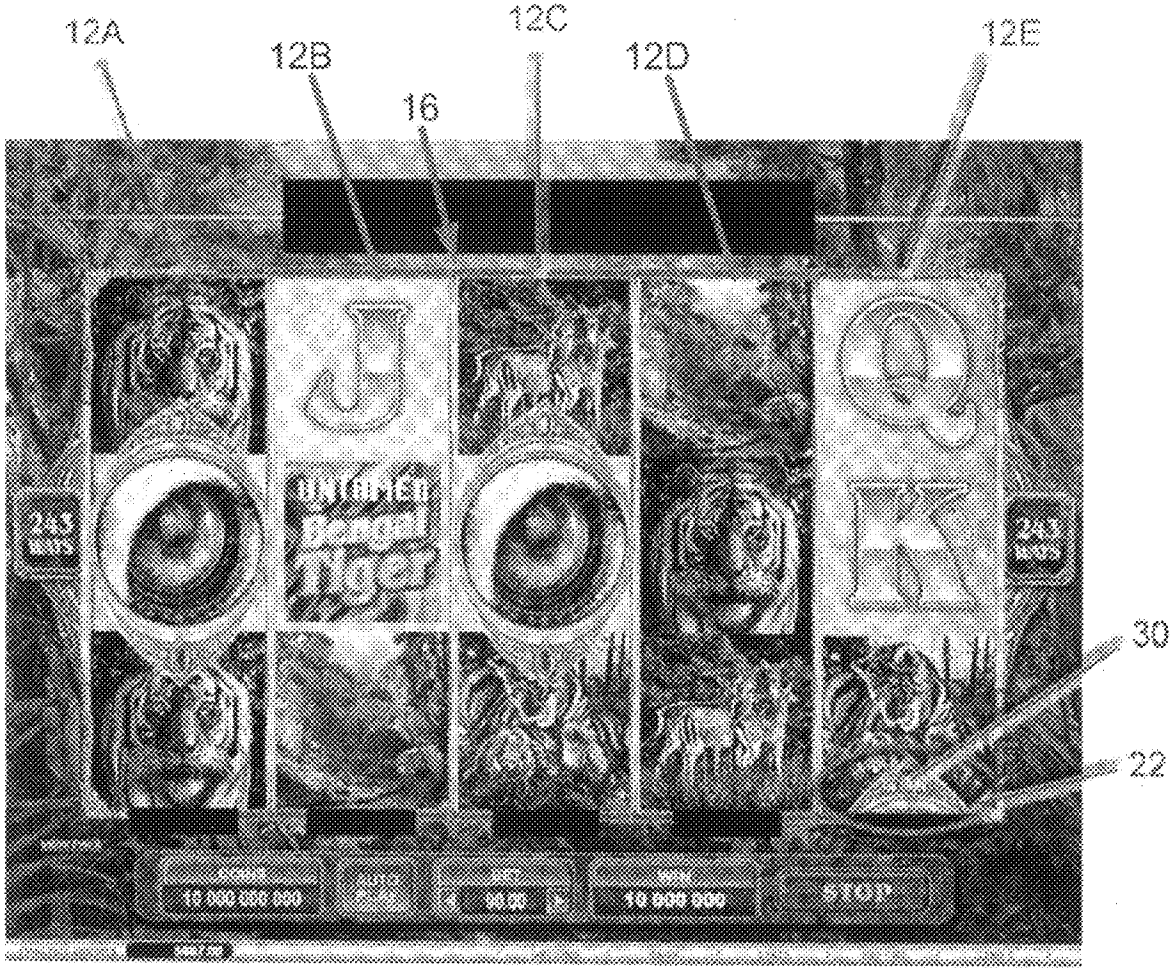
FIG. 2 is an illustration of the display of FIG. 1 after a spin of the reels. The display shows that a specific game symbol has appeared on the far left-hand reel and the centre reel. An identical off-reel symbol is also visible at the bottom of the far right-hand reel.

The array of symbols (14) of the video slot game may contain one or more "scatter" symbols represented in FIG. 1 by the "Eye" symbol (22). In one respect, the scatter symbols may be the same size as a regular non-scatter symbol (e.g., a height that equals a height of a row in the array of symbols (14) and a width that equals the width of a column in the array of symbols (14)). In another respect, however, the scatter symbols may have a height greater than the height of a row in the array of symbols 14, with the result that the tips (30) of the scatter symbol (22) overlap into the array positions immediately above and below the array position that contains the scatter symbol (22) itself. The overlapping tips (30) allow a player to become aware when a scatter symbol (22) has narrowly failed to land on the array of symbols (14) visible in the reel-display area (16), in other words, in the scatter symbol landed in an off-reel-display area. This is illustrated in FIG. 2 where the tip (30) of a scatter symbol that has landed just below the reel-display area (16) (i.e. an "off-reel-display scatter symbol") overlaps into the bottom array position of reel 12E.

Upon completion of a spin of the video slot game, any winning symbol combinations that appear in the reel-display area (16) are paid out according to a pay table associated with the game. Thereafter an automatic nudge feature is invoked if the reel-display area (16) reveals the presence of an off-reel-display scatter symbol and it is determined that the off-reel-display scatter symbol would result in an additional winning symbol combination if it were located within the reel-display area (16). The automatic nudge feature consists of movement of the off-reel-display scatter symbol by one symbol position to bring the off-reel-display scatter symbol within the reel-display area (16), thus completing the additional winning symbol combination, which is then paid out according to the game pay table.

Figure 3:
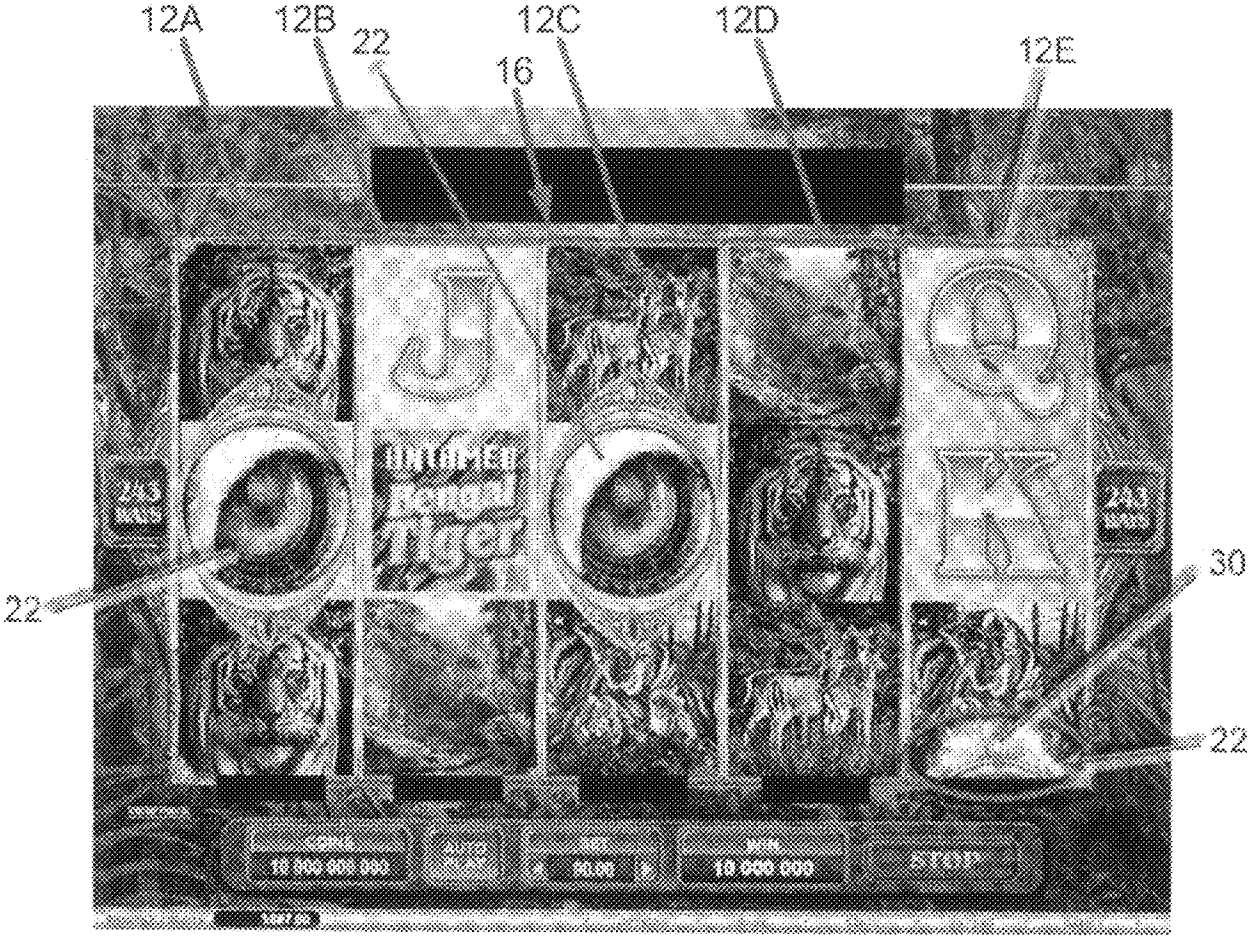
FIG. 3 is an illustration of the commencement of a nudge of the off-reel symbol on the far right-hand reel of FIG. 2 in which an animation of the visible portion of the off-reel symbol occurs.
Figure 4:
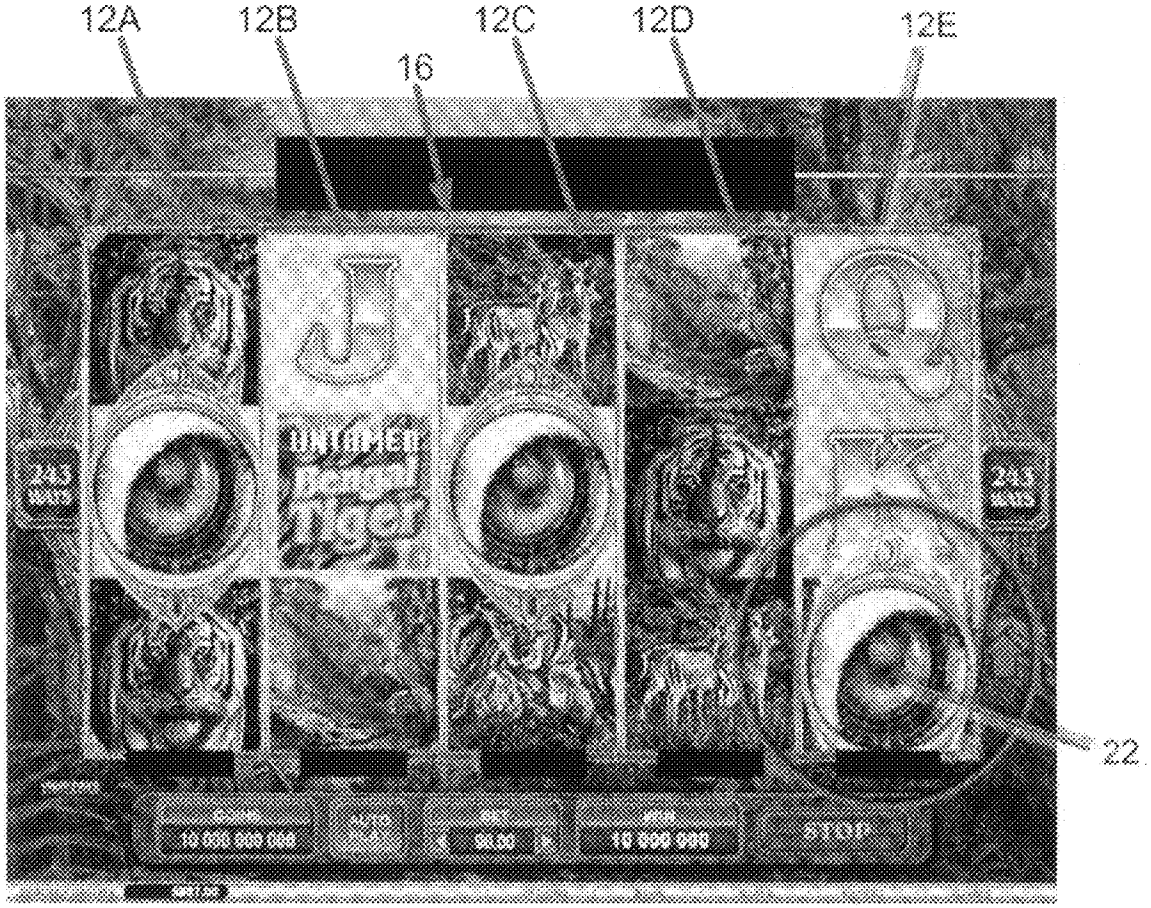
FIG. 4 is an illustration of the display of FIG. 3 after completion of a nudge of the off-reel symbol on the far right-hand reel into the reel-display area. The three specific symbols now appearing on the far left-hand, centre and far right-hand reel form an additional winning pay line symbol combination.

This is illustrated with reference to FIGS. 3 and 4. In this example, the pay table of the game (not shown) includes winning combinations of three, four or five scatter symbols, each with a corresponding payout. In FIG. 3, a spin of the reels has resulted in two scatter symbols (22) in the reel-display area (16), one on each of reels 12A and 12C and an off-reel-display scatter symbol (22), whose tip (30) is visible at the bottom of reel 12E. It is clear that if the off-reel-display scatter symbol (22) were within the reel-display area (16), a winning symbol combination would result. This condition triggers an automatic nudge feature which commences with an animation of the visible tip (30) of the off-reel-display scatter symbol (22) on reel 12E, as illustrated in FIG. 3. The animation is followed by an upwards nudge of the off-reel-display scatter symbol on reel 12E (i.e. an upwards movement of the off-reel symbol by one symbol position to bring the off-reel-display scatter symbol (22) on reel 12E into the reel-display area (16)) as shown in FIG. 4. The three scatter symbols (22) now in the reel-display area (16) result in an additional winning symbol combination, which is paid out according to the game pay table. It is anticipated that the automated nudge feature to bring off-reel-display scatter symbols within the reel-display area (16) to realise additional potential winning symbol combinations will sustain player interest in the game and greatly increase its attractiveness to players.

Clearly, numerous variations and permutations are possible to this embodiment without departing from the scope of the invention. For example:

1. In the above example, the automatic nudge feature moves an off-reel-display scatter symbol into the reel-display area (16) from the bottom of the reel-display area (16). In an alternative embodiment the automatic nudge feature may move an off-reel-display scatter symbol into the reel-display area (16) from the top of the reel-display area (16). In a further alternative embodiment the automatic nudge feature may move off-reel-display scatter symbols into the reel-display area (16) from both the top and the bottom of the reel-display area (16).
2. In the above example, a single off-reel-display scatter symbol (22) of the game may be nudged into the reel-display area (16) after a spin of the reels. In an alternative embodiment, more than one off-reel-display scatter symbol may be nudged simultaneously into the reel-display area (16) after a spin of the reels. In yet another alternative embodiment, more than one off-reel-display scatter symbol may be nudged into the reel-display area (16) after a spin of the reels, one after the other, in succession.
3. In an alternative embodiment, the nudge feature may apply to any other symbol (e.g., a regular non-scatter symbol) in the symbol set of the game instead of the scatter symbol. In a further alternative embodiment, the nudge feature may apply to more than one specific symbol in the symbol set of the game. In a yet further embodiment the nudge feature may apply to all symbols in the symbol set of the game.
4. In an alternative embodiment, if the nudge feature produces more than one additional winning symbol combination in the reel-display area (16), only one of the additional winning symbol combinations may be paid out (for example, the additional winning symbol combination with the highest payout according to the pay table of the game). Further alternatively, every additional winning symbol combination produced by the nudge feature may result in a corresponding payout.
5. In the above example, the nudge feature may only be invoked if appropriate conditions apply pursuant to one or more winning symbol combinations that appear in the reel-display area (16) and are first paid out according to the game pay table. In an alternative embodiment, the nudge feature may be invoked unconditionally if appropriate conditions apply, irrespective of whether or not any winning symbol combinations have previously appeared in the reel-display area (16).
6. In accordance with the example embodiments in which the nudge feature is carried out for regular non-scatter symbols, a determination whether to nudge one or more regular non-scatter symbols positioned in the off-reel-display area can include determining whether movement of those one or more regular non-scatter symbols causes a winning combination or a higher-valued winning combination to appear on a pay line within the reel-display area (16).

For example, if a given pay line does not currently include a winning combination of symbols, but a determination is made that moving the one or more regular non-scatter symbols onto that pay line would result in that pay line including a winning combination of symbols, then a nudge to move those one or more regular non-scatter symbols is carried out.

As another example, if a given pay line includes a winning combination of symbols that pays out an award of 100 credits and a determination is made that moving one or more non-regular symbols onto that pay line would result in that pay line including a winning combination of symbols that would earn an award greater than 100 credits, then a nudge to move those one or more regular non-scatter symbols is carried out. In some embodiments if a determination is made that moving the one or more symbols onto the pay line would result in the pay line displaying a combination of symbols that would earn an award less than the award earned by the combination of symbols currently displayed on that pay line (e.g., 100 credits), then the nudge feature is not carried out for those one or more symbols. Alternatively, those one or more symbols are moved onto the pay line and the second smaller award is paid in addition to the award earned for the first combination of symbols displayed on that pay line.

7. In accordance with the example embodiments, paying awards for winning symbol combinations based on a number of scatter symbol(s) appearing in the reel-display area (16) may be carried out in various manners. In a first case, if a sufficient number of scatter symbol(s) appear in the reel-display area (16) to win an award prior to moving an off-reel-display scatter symbol within the reel-display area (16), the machine may pay a first award based on the sufficient number of scatter symbol(s) and, thereafter, the machine pays a second award based on the quantity of scatter symbols within the reel-display area (16) after the off-reel-display scatter symbol(s) is moved into the reel-display area (16).

In accordance with the first case, the amount of the second award may equal the difference between (i) an amount that would have been awarded as the first award had the reel-display area (16) displayed the number of scatter symbols that appear in the reel-display area (16) after the off-reel-display scatter-symbol(s) are moved within the reel-display area (16), and (ii) the first award. In a second case, if a sufficient number of scatter symbol(s) appear in the reel-display area (16) to win an award prior to moving an off-reel-display scatter symbol(s) within the reel-display area (16), the machine may pay a single award based on the number of scatter symbols appearing in the reel-display area (16) after the off-reel-display scatter symbol(s) is moved into the reel-display area (16).

III. Game Playing Environments

The game functionality disclosed in this description can be carried out via various arrangements including, but not limited to, a stand-alone gaming machine arrangement, and a system arrangement comprising a gaming machine and gaming server communicatively coupled via a communication network. The features of this disclosure, such as nudging off-reel symbols (e.g., regular non-scatter symbols and/or scatter symbols) onto a reel displayed within a reel-display area, and providing notice of the appearance of a specific off-reel symbol on a reel of a reel-type game, can be implemented in a variety of game playing formats. Several representative examples of these formats will be described in this section.

In one format, a personal computer is loaded with game playing software which includes a reel-type game. The game can be played solely for amusement, in which case the computer is typically not interacting with any external resource which logs wagers, determines and communicates results, or adjusts a player's credit account. The game software presents the reels such as shown in FIGS. 1-4. When an off-reel "scatter symbol" (22) is present on a reel, the software for the game displays a portion (30) of the off-reel-display symbol (22) in the reel-display area (16) of the reel-type game as described above, as shown in the far-right reel (12E) in the example of FIG. 2. The software for the game then automatically nudges the off-reel symbol that appeared, by one symbol position so as to bring the off-reel symbol into the reel-display area (16) if and only if, by doing so, a winning symbol combination will result on a pay line of the game. A person skilled in the art will understand that this format is applicable to games played for wagers and with nudging of regular non-scatter symbols.

Figure 5:
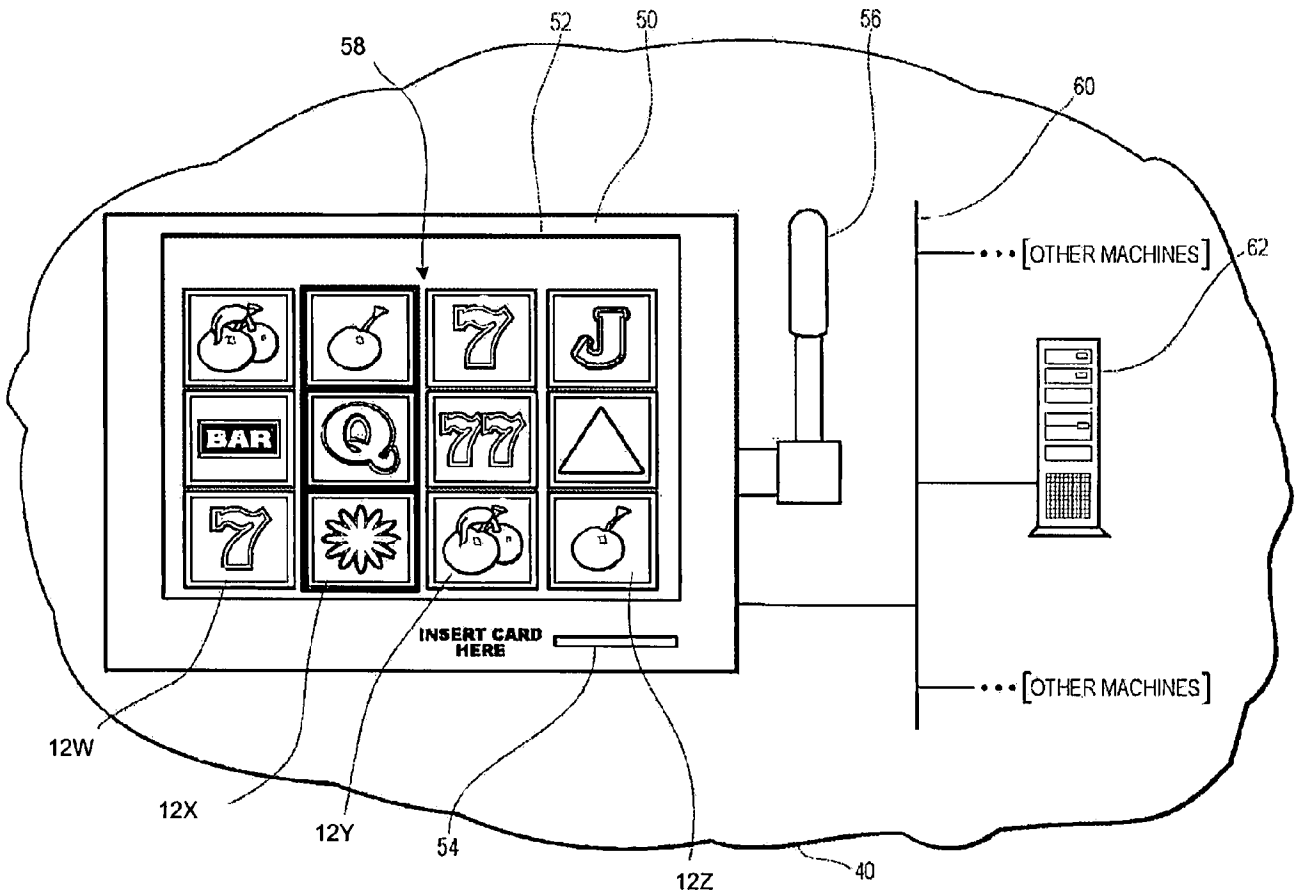
FIG. 5 is an illustration of an environment in which the game shown in FIGS. 1-4 can be played by a video gaming terminal in a casino or like establishment. In the embodiment of FIG. 5, the video gaming terminal is shown connected to a gaming server over a local area network.

In another format, the game may be played in a video gaming terminal, such as found in a land or ship-borne casino. One example of this embodiment is shown in FIG. 5. A casino (40) includes a plurality of game playing machines (50) (in this example, four reel video slot machines) which are connected to a local area network (60). A player inserts a card having a magnetic strip storing a credit amount into a slot (54) in the machine (50). The card is read and wager amounts are deducted from the value carried by the card. The machine (50) includes a display (52) showing four reels (12W, 12X, 12Y, and 12Z). The display (52) may also include features which are not shown, such as wager controls, which are conventional and not important. A turn of the game is initiated by a turn-initiation device, for example, by pulling on the handle (56) or by pressing a spin button, or in some other fashion.

In this example, the results of play are generated by a gaming server (62) using a random number generator (or other process to generate a set of reel symbols randomly). The gaming server (62) communicates the results of play to the video gaming terminal (50) over the network (60) as a packet or datagram containing data indicating which symbols are to be displayed on the reels (12). The datagram is processed by software resident on the video gaming terminal (50) and presented on the display (52) in known fashion. When the server's randomly generated results include an off-screen scatter symbol (22), the gaming server (62) may include with the datagram containing the results of the spin a data flag (e.g., a data bit) which indicates that the off-reel-display scatter symbol is associated with a particular reel (e.g., reel 12X).

Furthermore, the gaming server (62) may include with the datagram a further data flag (e.g., a data bit) indicating whether a one-position nudge of the off-reel symbol on reel (12X) is to be triggered to move the off-reel-display scatter symbol (22) into the reel-display area (58). Alternatively, the software resident in the terminal (50) may include logic or code which searches the datagram for data indicating that the off-reel-display scatter symbol (22) was returned as a result and whether a nudge is to be triggered, and if it finds such data a tip (30) of the off-reel-display scatter symbol (22) is displayed on the reel in question and a one-position nudge of the off-reel-display scatter symbol (22) is activated. For embodiments that nudge regular non-scatter symbols, the datagram may similarly include data flags indicating whether a one-position nudge of a regular non-scatter type symbol positioned in an off-reel-display area should be moved into the reel-display area (16).

Aspects for this invention are also particularly suited for use in the context of playing of wager games over a computer network. Moreover, many of the elements illustrated in FIG. 5 or the other figures and/or described herein are functional elements that may be implemented as discrete or distributed components or in conjunction with other components, and in any suitable combination and location. Those skilled in the art will appreciate that other arrangements and elements (for example, machines, interfaces, functions, orders, and groupings of functions, etc.) can be used instead. Furthermore, various functions described as being performed by one or more elements can be carried out by a processing unit executing computer-readable program instructions and/or by any combination of hardware, firmware, and software.

Figure 6:
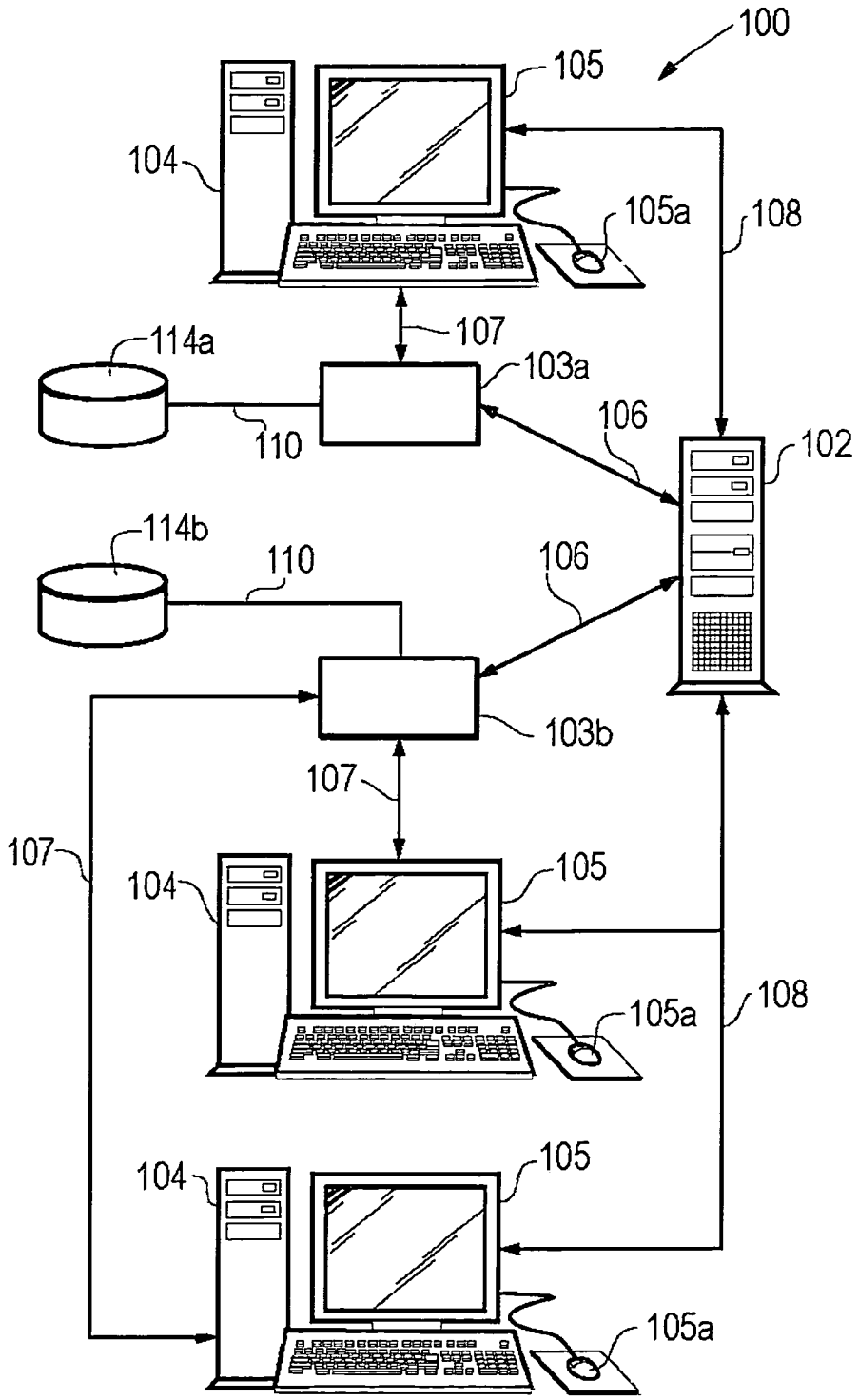
FIG. 6 is an is an illustration of an environment in which the game shown in FIGS. 1-4 can be played by computer workstations connected to a gaming server over a wide area network such as the Internet.

Referring to FIG. 6, a gaming system suitable for use in wager games and promotions of this disclosure is indicated generally by reference numeral (100). The gaming system (100) includes a central gaming server (102), and a number of portals (103*a*, 103*b*) in the form of portal websites on the World Wide Web of the Internet. In this embodiment, each one of the portal websites is an online casino website hosted on a corresponding casino web server (not shown). For convenience, embodiments of the invention will be described with particular reference to only two such online casino websites (103*a*, 103*b*). Other online casino websites may be present, or, alternatively, just one casino website may be present.

Each one of the online casino websites (103*a*, 103*b*) is accessible by a would-be player (not shown) through a player gaming workstation (104) in the form of an Internet-enabled computer workstation (e.g., general purpose computer) having a display monitor (105) and an associated pointing device (105*a*) such as a mouse or, alternatively, a touchpad. In this embodiment, online casino website 103*a* is shown as having one computer workstation (104) logically connected thereto, whereas casino website 103*b* is shown as being logically connected to two computer workstations (104). It will be appreciated by those skilled in the art that such online casino websites (103*a*, 103*b*) can be logically connected to any desired number of such computer workstations (104) simultaneously, which number is physically limited only by considerations of processing power and Internet access bandwidth.

The gaming server (102), the online casino web servers (not shown) corresponding to the online casino websites (103*a*, 103*b*), and the computer workstations (104) are capable of communicating with each other by means of an open communication network that is, in this embodiment, the Internet. The Internet is represented in FIG. 6 as separate logical communication networks (106, 107, 108 and 110). The particular networking topology used and presence of intermediate networks or switching equipment is not important, and may make use of intervening communications network such as the public switched telephone network, cable networks, cellular wireless networks, WiFi, WiMax, etc.

Each online casino operates an account facility (114*a* and 114*b*, respectively) with a credit account corresponding to each player who participates in a game offered by the online casino. In the illustrated embodiment, therefore, the credit account facility 114*a* has one player credit account associated with it, while credit account facility 114*b* has two associated, but separate, player credit accounts.

A stored workstation program (not shown) is resident in the client computer workstation (104) which enables a participating player to browse a casino website and to interact with the gaming server (102) to play wager games such as slots, poker, Black Jack, Roulette and other games. The stored workstation program includes display tools for displaying on the display monitor (105): gaming symbols (e.g., slot machine reels, cards, Roulette wheels, etc.), gaming controls by which the player can place wagers, spin the reels, etc., and the results of play. The stored workstation program also includes gaming logic for facilitating the execution of a turn of a game, and communications facilities for communicating player actions using the user interface to the central gaming server, and receiving datagrams from the gaming server containing results of play. The data representing results of play is translated to graphical symbols which are presented on the display monitor (105). Further details of the conventional features in these embodiments are known in the art and described in the patent literature, see e.g., U.S. Patent Application Publication No. 2007/0060303, which published on Mar. 15, 2007 from U.S. patent application Ser. No. 10/550,744 filed Sep. 23, 2005.

Each computer workstation (104) may take the form of a conventional personal computer operating under a Windows XP, ME, 2000 or other operating system, which is well known and commercially available from Microsoft Corporation of Redmond, Wash., or other operating system such as provided by Apple Computer or a Linux operating system. The gaming workstation may also take the form of a portable computing device such as personal digital assistant or cellular telephone. The gaming workstation may also take the form of an electronic gaming terminal. As an example, each computer workstation (104) may include one or more processing units, a display device to display the described reel-type games, a computer-readable data storage device (i.e., a memory device) storing computer-readable program instructions described in this disclosure, and a network interface for interconnecting with a gaming server that provides datagrams including data to carry out the games disclosed herein.

The gaming server (102) operates under control of a server-stored program (not shown) that co-operates with the stored workstation program in order to enable a player at the computer workstation (104) to play a game, such as a wager game. The gaming server (102) operates, for example, under the Windows NT operating system.

The stored workstation program or application (not shown) and the corresponding stored server program will be referred to, for convenience, as a client process and a server process, respectively. The server process generates one or more random events that determine the outcome of turns of the game, such as determining the outcome of spins of the slot machine reels in the various slots games of the participating players. Determining the outcome of spins may, for example, include determining each symbol to be placed in the M (rows)×N (columns) array of symbols (14) and either 2 times N symbols to be associated with off-reel-display symbol positions above and below each column of the reel-display area (16) or 2 times M symbols to be associated with off-reel-display symbol positions to the left and to the right of each row of the reel-display area (16). The server process may comprise executing the computer-readable program instructions disclosed herein as being executed by a gaming server and/or a processing unit of the gaming server.

The client process of any particular computer workstation (104) obtains the result of the random events from the gaming server (102) along the communication network (108) and displays the outcome of the game on the display monitor (105) of the workstation in an intelligible manner, by causing the player's set of slots reels to spin and to come to rest at a position corresponding to the outcome. The client process may comprise executing the computer-readable program instructions disclosed herein as being executed by the machine to play a reel-type game and/or a processing unit of that machine. The client process may include executing computer-readable program instruction to cause a display device to display animation of reels spinning within the reel-display area (16).

If the slot reels include an off-reel-display scatter symbol (22) whose tip (30) is visible in the reel-display area (16), a nudge of the reel in which the off-reel-display scatter symbol is triggered to bring the off-reel-display scatter symbol within the reel-display area (16) if, by so doing, a winning symbol combination will result on a pay line of the game. As noted, the instruction to trigger a reel nudge could come from the gaming server (102) in the form of a data flag or data bit in the datagram with the results of the spin, or alternatively the workstation program may detect the presence of the relevant symbol in the datagram and trigger the reel nudge.

The gaming server (102) thus generates results of spins of the reels for the workstations (104) and sends datagrams to the workstations indicating such results. In one possible embodiment, to generate the results of a spin of the reels, the gaming server (102) includes a memory (not shown, but conventional) storing data representing potential results for each of the reels. The gaming server uses a random process (e.g., random number generator) to select one of the results from memory. One of the results stored in the gaming server memory is data representing a result in the form of an off-reel-display scatter symbol (22).

The memory (e.g., data storage device) referred to in this description may comprise a non-transitory computer-readable storage medium readable by a processing unit. The computer-readable storage medium may comprise volatile and/or non-volatile storage components, such as optical, magnetic, organic or other memory or disc storage, which can be integrated in whole or in part with a processing unit.

In order to play the games from any particular computer workstation (104), the client process (not shown) must first be downloaded to that computer workstation from the gaming server (102) or, alternatively, from a separate web server (not shown), and then installed on the workstation.

In use, a player wishing to participate in a wager game uses a computer workstation (104) to access an online casino website (103*a*, 103*b*) of his choice. When the player navigates using a Web browser to a home page of a casino, a promotional message may be displayed (described below). The player is presented with an icon on the GUI on his computer workstation (104), which the player can activate in order to download the client process and register with the casino operator. Following these tasks, the player may request to play games provided on the casino website by clicking on an appropriate icon or taking other similar action.

The online casino websites (103*a*, 103*b*) may be provisioned as a virtual slots room where slots is the only game available to would-be players, rather than one where a variety of different games are offered to a player.

It will be noted again that a system implementing the methods of this invention need not include two (or more) separate casino websites (103*a*, 103*b*), and that only one website (103) may be linked to the gaming server (102).

In accordance with example embodiments disclosed herein, after spinning the reels for a turn of the game, the gaming server (102) and/or the computer workstation (104) may determine whether any of the symbols associated with an off-reel symbol position adjacent to a symbol position within the reel-display area (16), if moved into the reel-display area (16), would result in another or a higher-valued winning combination of symbols to be displayed in the reel-display area (16). If moving some or all of the off-reel-display symbols would not result in another or a higher-valued winning combination being displayed, then no movement of the off-reel-display symbols will occur for that turn of the game, and the gaming server (102) and/or computer workstation (104) will transition to wait for initiation of the next turn of the game.

IV. Conclusion

Example embodiments have been described above. Those skilled in the art will understand that changes and modifications may be made to the described embodiments without departing from the present invention, which is defined by the claims. In particular, any preferred or optional feature described with reference to one embodiment, example, aspect, or claim may equally be applied to any other embodiment, example, aspect, or claim, wherever appropriate.

We claim:

1. A method of displaying symbols by a display device of a reel-type gaming machine, the method comprising:

displaying, by the display device of the reel-type gaming machine, a reel-display area to display a plurality of reels and at least one payline, wherein each reel of the plurality of reels comprises a respective plurality of symbols;

displaying, by the display device, an animation of the plurality of reels spinning and then coming to rest within the reel-display area for a first turn of using the reel-type gaming machine;

displaying, within the reel-display area of the display device as a result of the plurality of reels spinning and then coming to rest for the first turn of using the reel-type gaming machine, at least a portion of a first symbol at a first symbol position of the reel-display area and a first portion of a first off-reel display symbol on the first symbol at the first symbol position, wherein a second portion of the first off-reel display symbol is not initially displayed within the reel-display area after the plurality of reels come to rest for the first turn of using the reel-type gaming machine, wherein the first symbol and the first off-reel display symbol are symbols of a first reel of the plurality of reels, and wherein the first symbol position is part of a first payline displayed within the reel-display area; and determining, by a processing unit, that locating the first off-reel display symbol to the first symbol position would result in the display device displaying a winning symbol combination that is not displayed on the first payline while displaying the result of the plurality of reels spinning and then coming to rest for the first turn, and afterwards, displaying, within the reel-display area of the display device, the first off-reel-display symbol relocated to the first symbol position and the winning symbol combination on the first payline, wherein displaying the first off-reel display symbol relocated to the first symbol position includes displaying the first portion of the first off-reel display symbol and the second portion of the first off-reel display symbol within the reel-display area, wherein displaying the result of the plurality of reels spinning and then coming to rest for the first turn of using the reel-type gaming machine includes displaying at least one more symbol of the first reel within the reel-display area, wherein each symbol of the at least one more symbol of the first reel is displayed at a respective position within the reel-display area, and wherein the at least one more symbol of the first reel does not change positions within the reel-display area when changing the display from displaying the result of the plurality of reels spinning and then coming to rest for the first turn of using the reel-type gaming machine to displaying the winning symbol combination that includes the first off-reel-display symbol relocated to the first symbol position.

2. The method of claim 1, further comprising:

while displaying the result of the plurality of reels spinning and then coming to rest for the first turn and prior to displaying the first-off-reel-display symbol relocated to the first symbol position and the winning symbol combination, paying, by the reel-type gaming machine, any award earned for one or more symbol combinations that are in the displayed result of the plurality of reels spinning and then coming to rest for the first turn.

3. The method of claim 1, further comprising:

paying, by the reel-type gaming machine, an award earned for displaying the winning symbol combination.

4. The method of claim 1, further comprising:

determining, by the processing unit, that an additional winning symbol combination would result in the display device if a second off-reel-display symbol is moved onto another symbol that is being displayed as part of the result of the plurality of reels spinning and then coming to rest for the first turn and that is adjacent to the second off-reel-display symbol.

5. The method of claim 4, further comprising:

determining, by the processing unit, that an award payable for displaying the winning symbol combination is greater than an award payable for displaying the additional winning symbol combination; and paying, by the reel-type gaming machine, an award earned for displaying the winning symbol combination.

6. The method of claim 4, further comprising:

moving the second off-reel-display symbol onto the displayed symbol adjacent to the second off-reel-display symbol; and paying, by the reel-type gaming machine, an award earned for displaying the winning symbol combination and the additional winning symbol combination.

7. The method of claim 1, further comprising:

displaying movement of the first off-reel-display symbol in a first direction as the first off-reel-display symbol is relocated to the first symbol position, wherein the plurality of reels, while spinning for the first turn, spin in the first direction or in a second direction that is opposite the first direction.

8. The method of claim 1, further comprising:

receiving, at a network interface of the reel-type gaming machine, a datagram that includes data identifying the result of the plurality of reels spinning and then coming to rest for the first turn of using the reel-type gaming machine, wherein the result of the plurality of reels spinning and then coming to rest for the first turn comprises a symbol for each symbol position visible within the reel-display area and a plurality of symbols for symbol positions outside of the reel-display area, and wherein the datagram received at the network interface was transmitted to the network interface via a communications network external to the reel-type gaming machine.

9. A machine configured to enable a player to play a reel-type game, the machine comprising:

a processing unit;

a non-transitory computer-readable storage medium storing computer-readable program instructions executable by the processing unit; and a display device configured to provide a reel-display area to display a plurality of reels and at least one payline, wherein each reel of the plurality of reels comprises a respective plurality of symbols, wherein the computer-readable program instructions are executable by the processing unit to cause the display device to display an animation of the plurality of reels spinning and then coming to rest within the reel-display area for a first turn of using the reel-type gaming machine, wherein the computer-readable program instructions are executable by the processing unit to cause the display device to display, within the reel-display area of the display device as a result of the plurality of reels spinning and then coming to rest for the first turn of playing the reel-type game, at least a portion of a first symbol at a first symbol position of the reel-display area and a first portion of a first off-reel display symbol on the first symbol at the first symbol position, wherein a second portion of the first off-reel display symbol is not initially displayed within the reel-display area after the plurality of reels come to rest for the first turn of using the reel-type gaming machine, wherein the first symbol and the first off-reel display symbol are symbols of a first reel of the plurality of reels, wherein the first symbol position is part of a first payline displayed within the reel-display area, wherein the computer-readable program instructions are executable by the processing unit to cause the processing unit to determine that locating the first off-reel display symbol to the first symbol position would result in the display device displaying a winning symbol combination that is not displayed on the first payline while displaying the result of the plurality of reels spinning and then coming to rest for the first turn and to afterwards cause the display device to display, within the reel-display area of the display device, the first off-reel-display symbol relocated to the first symbol position and the winning symbol combination on the first payline, wherein displaying the first off-reel display symbol relocated to the first symbol position includes displaying the first portion of the first off-reel display symbol and the second portion of the first off-reel display symbol within the reel-display area, wherein displaying the result of the plurality of reels spinning and then coming to rest for the first turn of using the reel-type game includes displaying at least one more symbol of the first reel within the reel-display area, wherein each symbol of the at least one more symbol of the first reel is displayed at a respective position within the reel-display area, and wherein the at least one more symbol of the first reel does not change positions within the reel-display area when changing the display from displaying the result of the plurality of reels spinning and then coming to rest for the first turn of playing the reel-type game to displaying the winning symbol combination that includes the first off-reel-display symbol relocated to the first symbol position.

10. The machine of claim 9, further comprising:

a network interface configured to transmit communications destined for a gaming server via a communications network external to the machine, and to receive, via the communications network, communications destined for the machine from the gaming server, wherein a first communication destined for the gaming server comprises data to trigger the gaming server to generate data to be displayed as the result of the plurality of reels spinning and then coming to rest for the first turn of the reel-type game, and wherein a first communication destined for the machine from the gaming server comprises the data to be displayed as the result of the plurality of reels spinning and then coming to rest for the first turn of the reel-type game.

11. The machine of claim 10, further comprising:

a turn-initiation device to initiate each turn of the reel-type game, wherein initiation of the first turn of the reel-type game causes the processing unit to generate the first communication destined for the gaming server and to provide the first communication destined for the gaming server to the network interface for subsequent transmission to the gaming server via the communications network.

12. A gaming server configured to communicate with a machine that enables a player to play a reel-type game via a communications network, the gaming server comprising:

a processing unit configured to generate results of a plurality of reels spinning and then coming to rest for each turn of the reel-type game being played at the machine and to cause the generated results of the plurality of reels spinning and then coming to rest in the reel-type game to be transmitted to the machine as a respective datagram for each turn of the reel-type game via the communications network, wherein a first datagram generated by the processing unit for a first turn of the reel-type game includes data indicating a result of the plurality of reels spinning and then coming to rest for the first turn of the reel-type game, wherein the result includes at least a portion of a first symbol at a first symbol position of the reel-display area and a first portion of a first off-reel display symbol on the first symbol at the first symbol position, wherein a second portion of the first off-reel display symbol is not initially displayed within the reel-display area after the plurality of reels come to rest for the first turn of using the reel-type gaming machine, wherein the first symbol and the first off-reel display symbol are symbols of a first reel of the plurality of reels, wherein the first symbol position is part of a first payline displayed within the reel-display area, wherein the processing unit is configured to determine that locating the first off-reel display symbol to the first symbol position would result in the machine displaying a winning symbol combination that is not displayed on the first payline while displaying the result of the plurality of reels spinning and then coming to rest for the first turn of the reel-type game, wherein the first datagram includes data to cause the machine to display, within the reel-display area, the first off-reel-display symbol relocated to the first symbol position and the winning symbol combination on the first payline, wherein displaying the first off-reel display symbol relocated to the first symbol position includes displaying the first portion of the first off-reel display symbol and the second portion of the first off-reel display symbol within the reel-display area, wherein the data indicating the result of the plurality of reels spinning and then coming to rest for the first turn of the reel-type game includes data indicating at least one more symbol of the first reel to display within the reel-display area, wherein each symbol of the at least one more symbol of the first reel is to be displayed at a respective position within the reel-display area, and wherein the at least one more symbol of the first reel does not change positions within the reel-display area when changing the display from displaying the result of the plurality of reels spinning and then coming to rest for the first turn of the reel-type game to displaying the winning symbol combination that includes the first off-reel-display symbol relocated to the first symbol position.

13. The gaming server of claim 12, further comprising:

a computer-readable storage medium storing computer-readable program instructions executable by the processing unit and data representing potential results for each reel of the plurality of reels to be displayed by the machine, wherein, for each turn of the reel-type game to be played at the machine, the computer-readable program instructions are executable to randomly select, from the computer-readable storage medium, one of the potential results for each reel of the plurality of reels to be displayed by the machine.

14. A method of facilitating play of a reel-type game at a machine that communicates with a gaming server via a communications network, the method comprising:

generating, by a processing unit of the gaming server, a result of a plurality of reels spinning and then coming to rest for a first turn of the reel-type game at the machine;

generating, by the processing unit, a first datagram including data indicating the result of the plurality of reels spinning and then coming to rest for the first turn of the reel-type game, wherein the result includes at least a portion of a first symbol at a first symbol position of the reel-display area and a first portion of a first off-reel display symbol on the first symbol at the first symbol position, wherein a second portion of the first off-reel display symbol is not initially displayed within the reel-display area after the plurality of reels come to rest for the first turn of using the reel-type gaming machine, wherein the first symbol and the first off-reel display symbol are symbols of a first reel of the plurality of reels, wherein the first symbol position is part of a first payline displayed within the reel-display area;

determining, by the processing unit, that locating the first off-reel display symbol to the first symbol position would result in the machine displaying a winning symbol combination that is not displayed on the first payline while displaying the result of the plurality of reels spinning and then coming to rest for the first turn of the reel-type game, wherein the first datagram includes data to cause the machine to display, within the reel-display area, the first off-reel-display symbol relocated to the first symbol position and the winning symbol combination on the first payline, wherein displaying the first off-reel display symbol relocated to the first symbol position includes displaying the first portion of the first off-reel display symbol and the second portion of the first off-reel display symbol within the reel-display area, and transmitting, from the gaming server to the machine via the communications network, the first datagram, wherein displaying the result of the plurality of reels spinning and then coming to rest for the first turn of using the reel-type gaming machine includes displaying at least one more symbol of the first reel within the reel-display area, wherein each symbol of the at least one more symbol of the first reel is displayed at a respective position within the reel-display area, and wherein the at least one more symbol of the first reel does not change positions within the reel-display area when changing the display from displaying the result of the plurality of reels spinning and then coming to rest for the first turn of using the reel-type gaming machine to displaying the winning symbol combination that includes the first off-reel-display symbol relocated to the first symbol position.

15. The method of claim 14, further comprising:

storing, at a computer-readable storage medium of the gaming server, computer-readable program instructions executable by the processing unit and data representing potential results for each reel of the plurality of reels to be displayed by the machine, wherein, for each turn of the reel-type game to be played at the machine, the computer-readable program instructions are executed to randomly select, from the computer-readable storage medium, one of the potential results for each reel of the plurality of reels to be displayed by the machine.

16. A system comprising:

a gaming server communicatively connected to a reel-type gaming machine, wherein the gaming server comprises first processing means configured to generate a first datagram for communicating a simulation result of a plurality of reels spinning and then coming to rest for a first turn of a reel-type game at the gaming machine, the first datagram including data representing at least a portion of a first symbol at a first symbol position of the reel-display area and a first portion of a first off-reel display symbol on the first symbol at the first symbol position, wherein a second portion of the first off-reel display symbol is not initially displayed within the reel-display area after the plurality of reels come to rest for the first turn of using the reel-type gaming machine, wherein the first symbol and the first off-reel display symbol are symbols of a first reel of the plurality of reels, wherein the first symbol position is part of a first payline displayed within the reel-display area, wherein each reel of the plurality of reels comprises a respective plurality of symbols, wherein the gaming machine comprises display means including the reel-display area, wherein the gaming machine is configured to receive the first datagram from the gaming server, wherein the gaming machine includes second processing means configured to display the result of the plurality of reels spinning and then coming to rest for the first turn of the reel-type game in the reel-display area, and wherein the second processing means is configured to determine that locating the first off-reel display symbol to the first symbol position would result in the display means displaying a winning symbol combination that is not displayed on the first payline while displaying the result of the plurality of reels spinning and then coming to rest for the first turn of the reel-type game and to afterwards cause the display means to display, within the reel-display area, the first off-reel display symbol relocated to the first symbol position and the winning symbol combination on the first payline, wherein displaying the first off-reel display symbol relocated to the first symbol position includes displaying the first portion of the first off-reel display symbol and the second portion of the first off-reel display symbol within the reel-display area, wherein the simulation result of the plurality of reels spinning and then coming to rest for the first turn of using the reel-type game at the gaming machine includes displaying at least one more symbol of the first reel within the reel-display area, wherein each symbol of the at least one more symbol of the first reel is displayed at a respective position within the reel-display area, and wherein the at least one more symbol of the first reel does not change positions within the reel-display area when changing the display from displaying the result of the plurality of reels spinning and then coming to rest for the first turn of using the reel-type game at the gaming machine to displaying the winning symbol combination that includes the first off-reel-display symbol relocated to the first symbol position.

17. A system as claimed in claim 16, wherein causing the display means to display the first off-reel display symbol relocated to the first symbol position and the winning symbol combination on the first payline is contingent on the gaming machine determining that a first value of an award associated with displaying the winning combination on the first payline is greater than a second value of an award associated with the displayed symbols associated with displaying the result of the plurality of reels spinning and then coming to rest for the first turn of the reel-type game.

18. A system as claimed in claim 16, wherein the first datagram comprises a data flag indicating whether or not the gaming machine is to update the display of the reel associated with the first off-reel-display symbol represented in the first datagram so as to display the first off-reel-display symbol.

19. A gaming server for controlling a gaming machine, the server comprising:

processing means configured to generate a result of a plurality of reels spinning and then coming to rest for a first turn of a reel-type game, and to communicate the result to the gaming machine as a first datagram, wherein each reel of the plurality of reels comprises a respective plurality of symbols, wherein the first datagram comprises data indicating the result of the plurality of reels spinning and then coming to rest for the first turn of the reel-type game to be displayed at a reel-display area by the gaming machine, wherein the result of the plurality of reel spinning and then coming to rest for the first turn of the reel-type game includes at least a first portion of a first symbol at a first symbol position of the reel-display area and a first portion of a first off-reel display symbol on the first symbol at the first symbol position, wherein a second portion of the first off-reel display symbol is not initially displayed within the reel-display area after the plurality of reels come to rest for the first turn of using the reel-type gaming machine, wherein the first symbol and the first off-reel display symbol are symbols of a first reel of the plurality of reels, wherein the processing means is configured to determine that locating the first off-reel display symbol to the first symbol position would result in the gaming machine displaying a winning symbol combination that is not displayed on the first payline while displaying the result of the plurality of reels spinning and then coming to rest for the first turn and to afterwards cause the gaming machine to display, within the reel-display area, the first off-reel-display symbol relocated to the first symbol position and the winning symbol combination on the first payline, wherein displaying the first off-reel display symbol relocated to the first symbol position includes displaying the first portion of the first off-reel display symbol and the second portion of the first off-reel display symbol within the reel-display area, wherein the data indicating the result of the plurality of reels spinning and then coming to rest for the first turn of the reel-type game includes data indicating at least one more symbol of the first reel to be displayed within the reel-display area, wherein each symbol of the at least one more symbol of the first reel is to be displayed at a respective position within the reel-display area, and wherein the at least one more symbol of the first reel does not change positions within the reel-display area when changing the display from displaying the result of the plurality of reels spinning and then coming to rest for the first turn of the reel-type game to displaying the winning symbol combination that includes the first off-reel-display symbol relocated to the first symbol position.

20. The method of claim 1, wherein displaying the first off-reel display symbol relocated to the first symbol position and the winning symbol combination includes displaying the first off-reel display symbol moved onto the first symbol at the first symbol position.

21. The method of claim 1, wherein displaying the first off-reel display symbol relocated to the first symbol position and the winning symbol combination includes bringing the first off-reel display symbol from the position adjacent to the first symbol position to within the reel-display area.

22. The method of claim 1, wherein locating the first off-reel display symbol to the first symbol position includes replacing the first symbol at the first position with the first off-reel display symbol.

23. The method of claim 1, wherein displaying the result of the plurality of reels spinning and then coming to rest for the first turn of using the reel-type gaming machine includes displaying a portion of the first off-reel display symbol as overlapping a portion of the first symbol at the first symbol position of the reel-display area.

24. The method of claim 1, wherein displaying the result of the plurality of reels spinning and then coming to rest for the first turn of using the reel-type gaming machine includes displaying a multitude of symbols with the reel-display area, wherein each symbol of the multitude of symbols is displayed at a respective position within the reel-display area, wherein the multitude of symbols includes the first symbol, and wherein the multitude of symbols do not change positions within the reel-display area when changing the display from displaying the result of the plurality of reels spinning and then coming to rest for the first turn of using the reel-type gaming machine to displaying the winning symbol combination.

* * * * *